US005498221A

United States Patent [19]

Blair, Jr.

[11] Patent Number: 5,498,221

[45] Date of Patent: Mar. 12, 1996

[54] HIP-TURNING EXERCISE MACHINE

[76] Inventor: Clifford Blair, Jr., 129 Longmeadow Dr., Holbrook, Mass. 02343

[21] Appl. No.: 332,129

[22] Filed: Oct. 31, 1994

[51] Int. Cl.[6] ..... A63B 21/06

[52] U.S. Cl. ..... 482/99; 482/139

[58] Field of Search ..... 482/99, 92, 93, 482/94, 98, 101, 102, 103, 139, 138, 83, 88, 124, 126, 129, 138, 139, 140, 148

[56] References Cited

U.S. PATENT DOCUMENTS 4,229,002 10/1980 Masters ..... 482/99
4,428,577 1/1984 Weingardt ..... 482/139
4,563,003 1/1986 Bugallo et al. ..... 482/100
4,640,268 2/1987 Roberts ..... 482/139

*Primary Examiner*—Stephen R. Crow
*Attorney, Agent, or Firm*—John P. McGonagle

[57] ABSTRACT

A wall-mounted frame assembly to which is attached a pulley-controlled variable weight structure. The weight structure is engaged via pulleys by a hand-held yoke assembly. The yoke is adapted to be held by the exerciser so that a hip-turning motion will be resisted by the weight structure.

8 Claims, 5 Drawing Sheets

HIP-TURNING EXERCISE MACHINE

BACKGROUND OF THE INVENTION

This invention relates to physical exercise machines, and in particular to apparatus for exercise and development of the hip muscles.

Most sports require a hip-generated, body turning motion to execute and provide power in certain physical acts unique to the sport. Examples of this include: track and field—hammer throw, discus throw, shot put, javelin throw; baseball—bat swing and ball throw; tennis—racket swing; football—ball throw; golf—club swing; swimming—leg kick; and the like. The hips contain the highest concentration of fast twitch muscle fibers in the body. The stronger the hip muscles are, the quicker and more relaxed the athlete becomes in athletic ability. Among the muscles grouped in the hip area are the gluteus medius, gluteus maximus, tensor fasciae latae, internal and external obliques, and other muscles interconnecting thereto.

Prior art machines have attempted to provide a means for exercising the hip area, but all are limited. In some cases, such as static weights, superior strength is required in the limbs and torso to provide and transfer actual exercise benefits to the hip area. Other machines, such as those found in U.S. Pat. Nos. 4,296,924; 4,243,219; 4,229,002; and 2,134,451; do not isolate the hip muscles and require substantial upper torso strength to provide and transfer actual exercise benefits to the hip area. Other types of machines do not permit freedom of movement or changes in angles while working the hip areas. Many machines aimed at exercising the torso, require the exerciser to sit while exercising, an unnatural position for many of the sports listed above.

SUMMARY OF THE INVENTION

In view of the foregoing disadvantages inherent in the known types of devices now present in the prior art, the present invention provides an improved hip strengthening exercise apparatus. As such, the general purpose of the present invention, which will be described subsequently in greater detail, is to provide a new and exercise apparatus which isolates and thoroughly works the maze of fast twitch fibers in the hips. Unlike prior art exercise equipment, the present invention allows the exerciser some freedom of movement, working the exerciser's hips at slightly different angles with each repetition. The exerciser interacts with the exercise machine while on his or her feet thereby more closely duplicating the actual movements required by the sports activities for which the exerciser is attempting to improve.

To attain these objectives, the present invention provides a wall-mounted frame assembly to which is attached a pulley-controlled variable weight structure. The weight structure is engaged via pulleys by a hand-held yoke assembly. The yoke is adapted to be held by the exerciser so that a hip-turning motion will be resisted by the weight structure.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
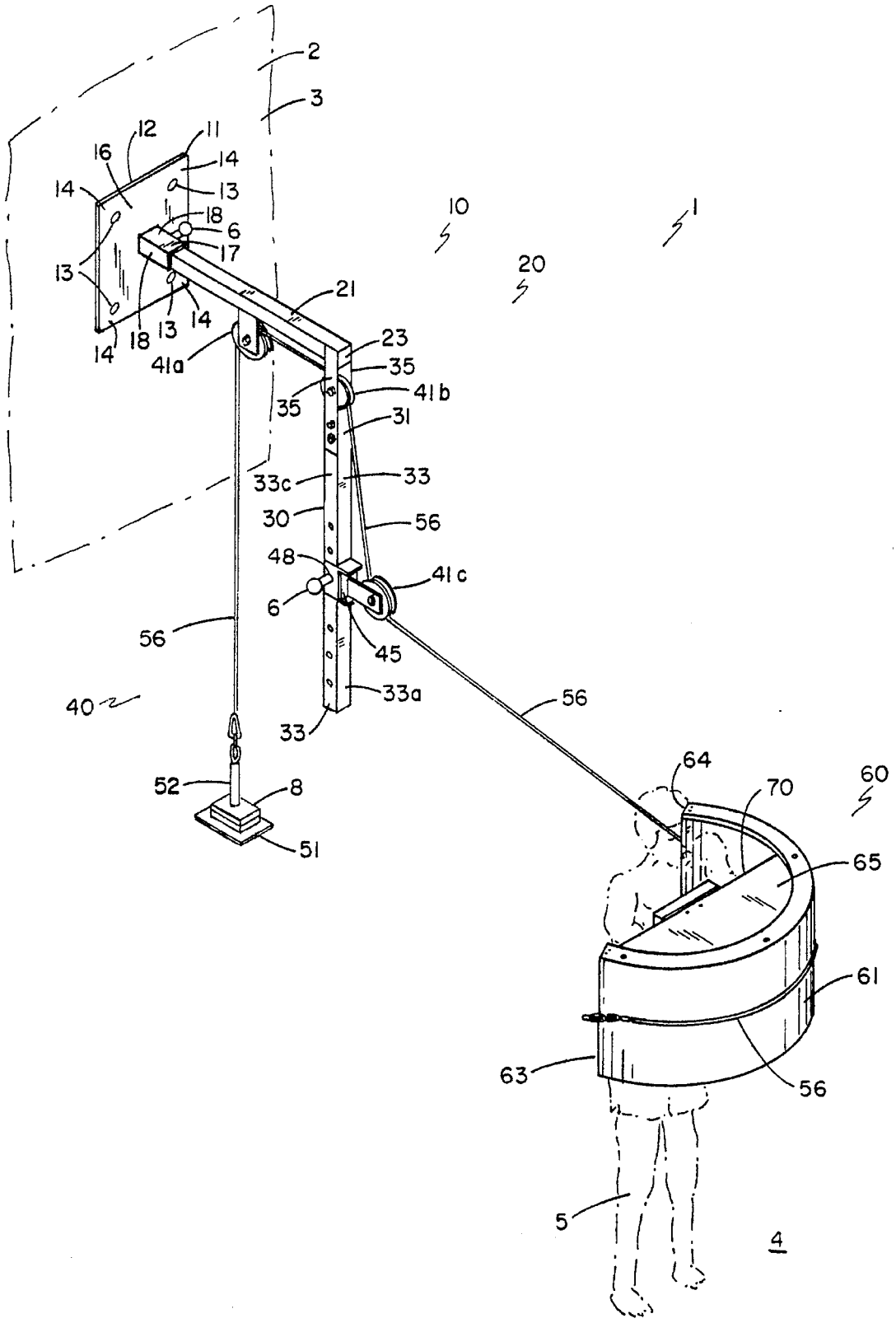
FIG. 1 is a perspective view of the present invention.
Figure 2:
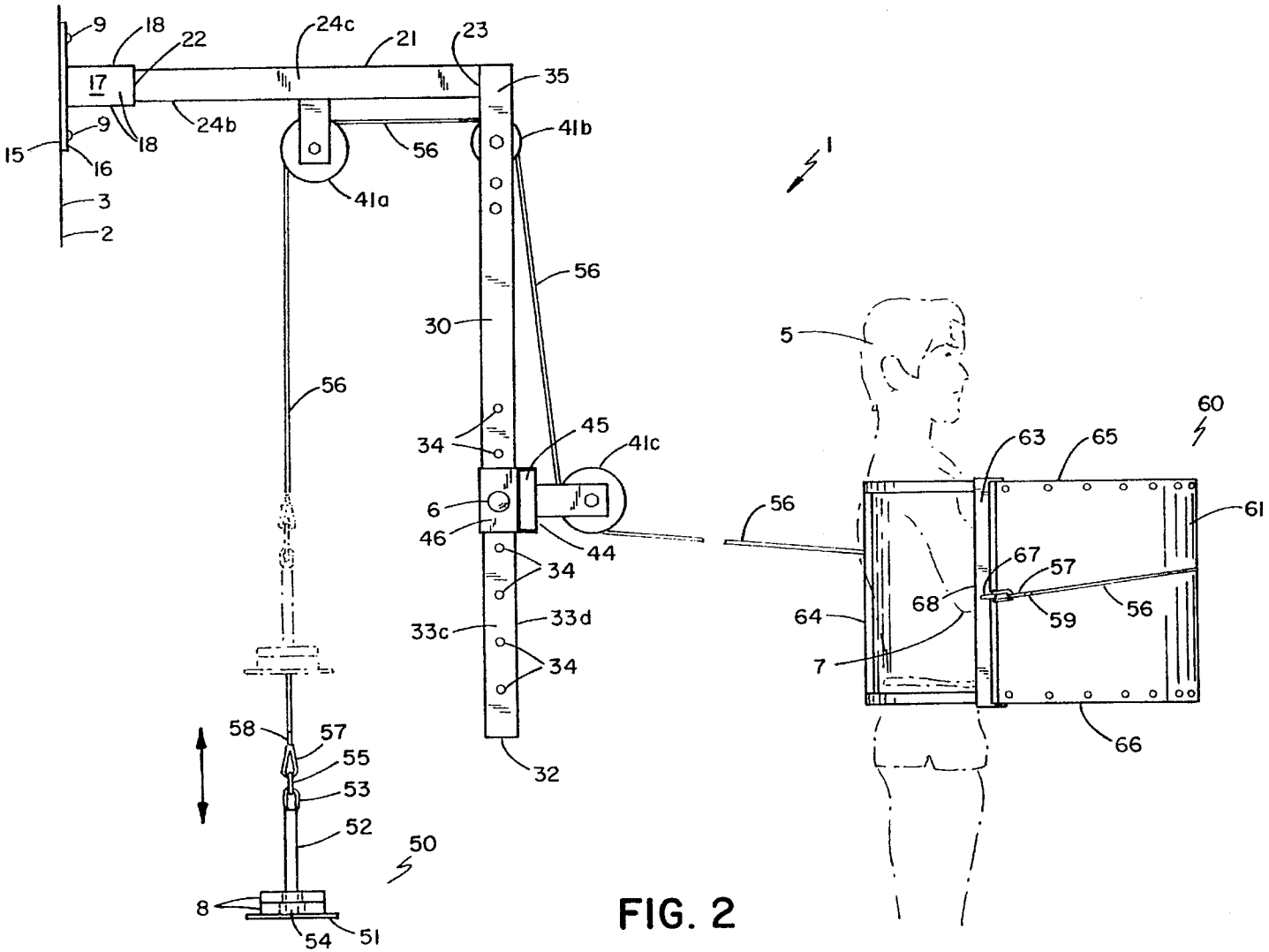
FIG. 2 is a side elevational view of the invention.
Figure 3:
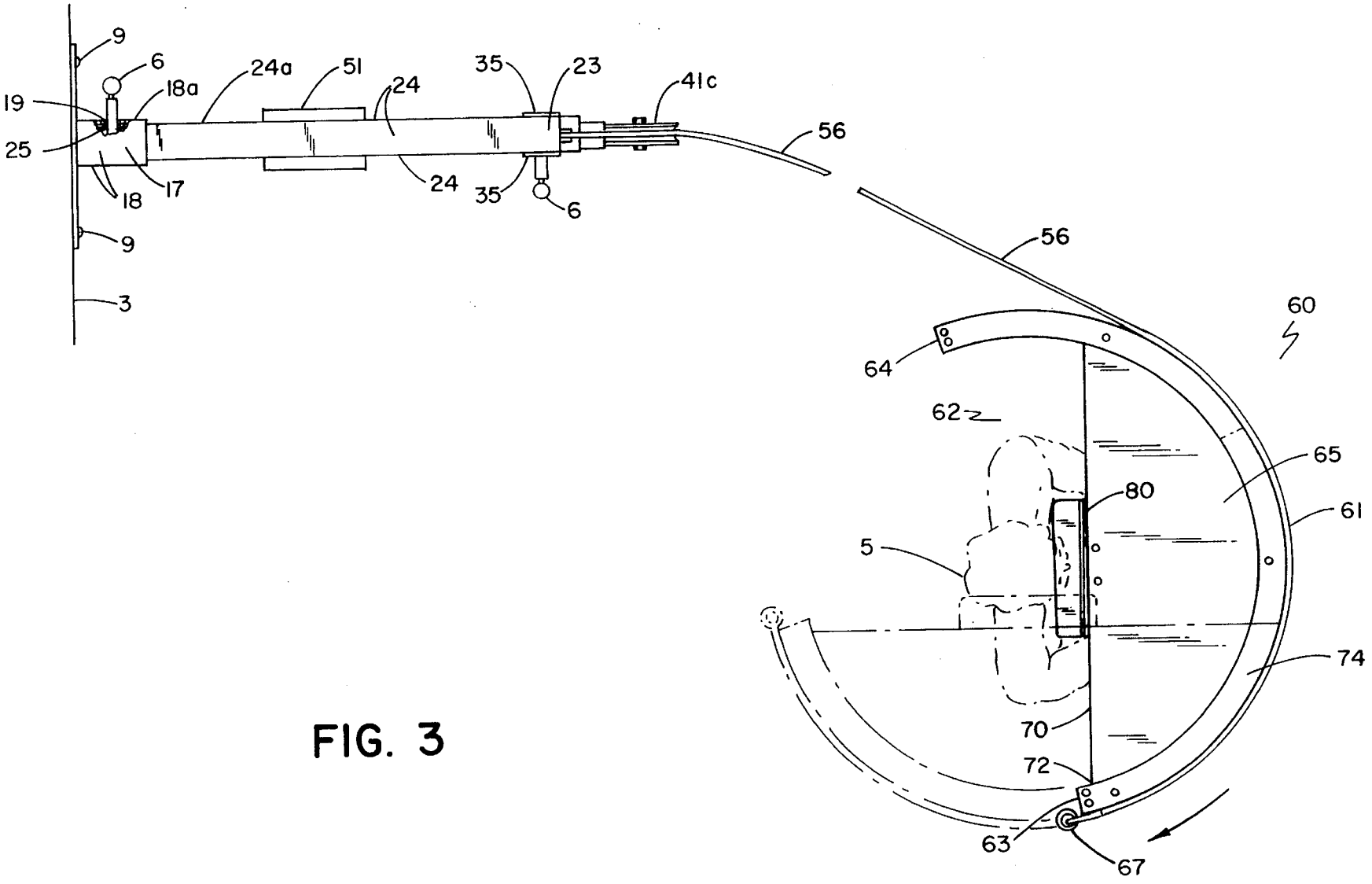
FIG. 3 is a top view of the invention.
Figure 4:
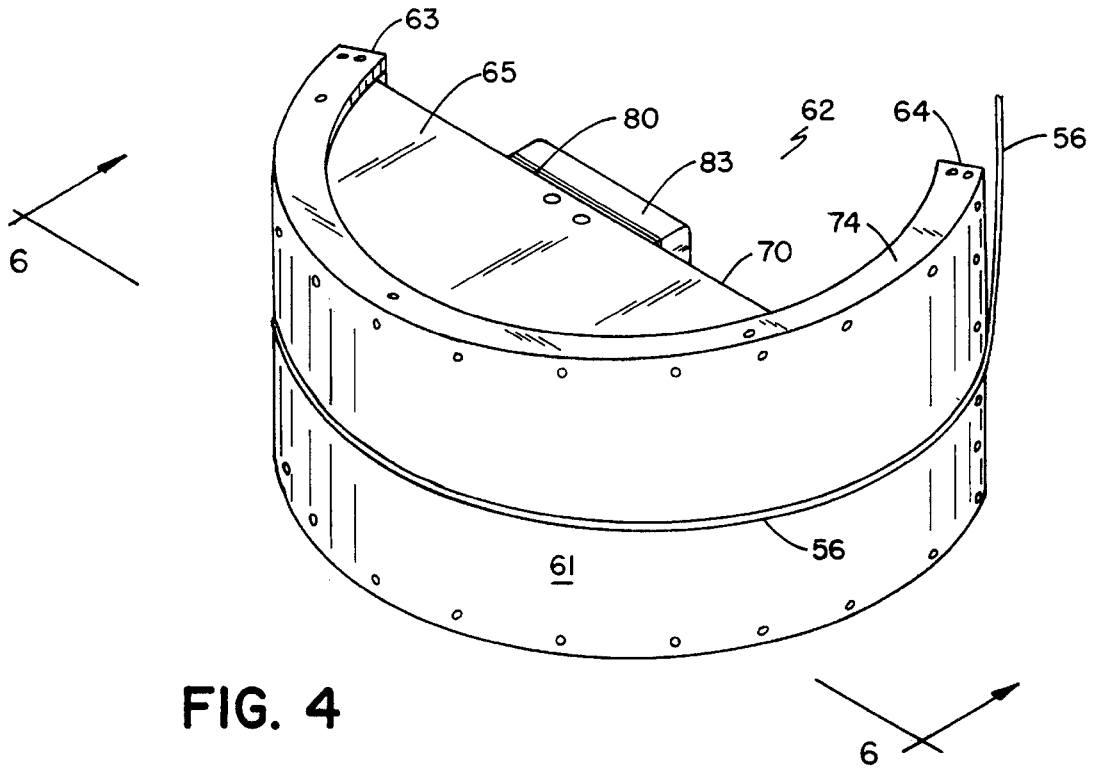
FIG. 4 is a front perspective view of the invention yoke.
Figure 5:
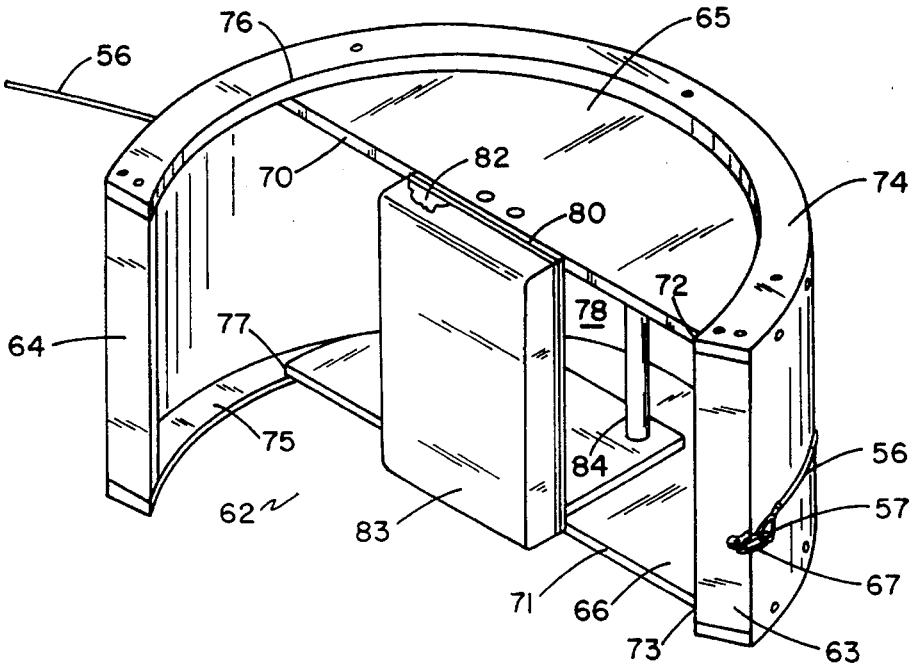
FIG. 5 is a rear perspective view of the invention yoke.
Figure 6:
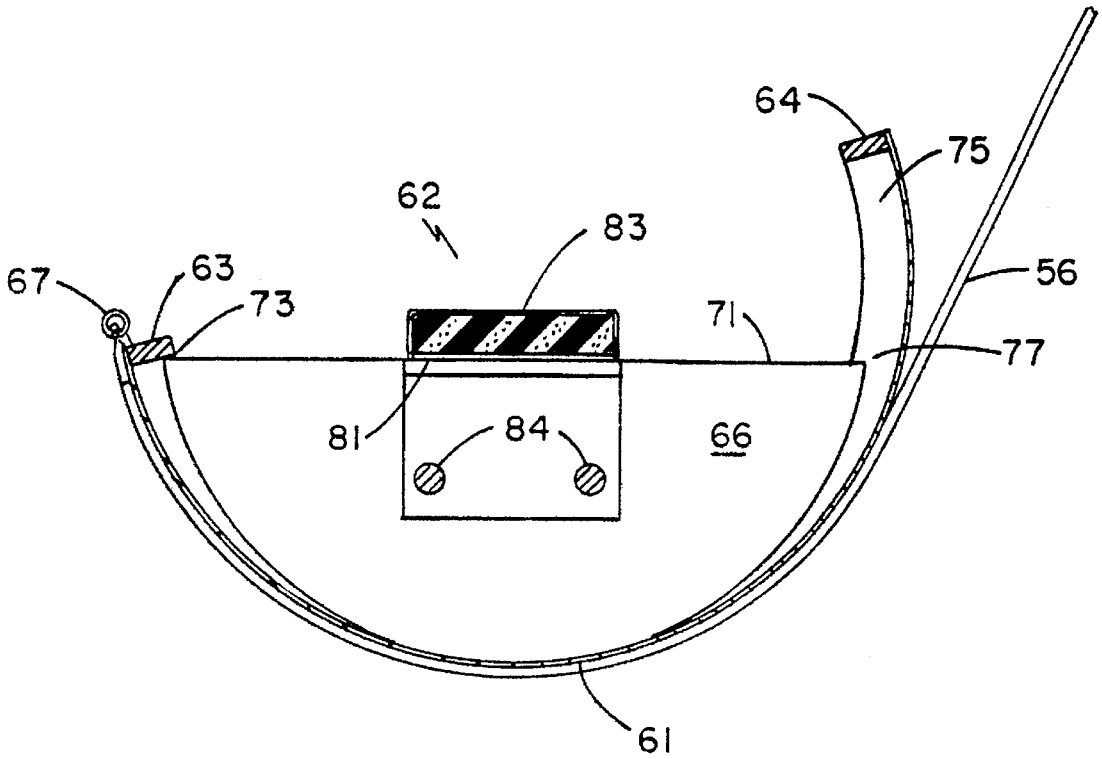
FIG. 6 is a sectional view of the yoke along the line 6—6 of FIG. 4.

Referring to the drawings in detail wherein like elements are indicated by like numerals, there is shown an embodiment of the turn machine invention 1. The present invention provides a frame assembly 10 to which is attached a pulley-controlled variable weight structure 40. The weight structure 40 is engaged by a hand-held yoke assembly 60. In this embodiment of the invention, the frame assembly 10 is mounted on a wall 2. In other embodiments, the frame assembly 10 could be mounted onto other structures or be free-standing.

The frame assembly 10 has two basic sections, a wall-mounted holding section 11 and an L-shaped support section 20. The holding section 11 is comprised of a generally square, flat, plate-like portion 12 with four holes 13 formed therein, one 13 near each of the corners 14. The plate 12 lies in a vertical plane parallel to the plane of the wall surface 3. The plate 12 has an under surface 15 and an outer surface 16. The under surface 15 is positioned against the wall surface 3 and attached thereto by means of fasteners 9 inserted through the plate holes 13 and inserted into the wall surface 3. The outer surface 16 faces away from the wall surface 3 and has an open piece of hollow tubing 17 centrally, perpendicularly and fixedly attached thereto. The tubing piece 17 has a square cross-section and four external surface sides 18. One side **18*a* has an aperture 19 formed therein for insertion of a spring loaded bolt 6**.

The L-shaped support section 20 has a horizontal segment 21 with a proximal end 22 and a distal end 23. The horizontal segment 21 has a square cross-section and four external surface sides 24. One horizontal segment side **24*a* has an aperture 25 formed therein near to the horizontal segment proximal end 22. The cross-section of the horizontal segment 21 is less than the cross-section of the tubing piece 17. The horizontal segment proximal end 22 is inserted into the plate tubing 17. The plate tubing spring bolt 6 engages the horizontal segment aperture 25 thereby locking the horizontal segment 21** in place.

The L-shaped support section 20 also has a vertical segment 30 with a top end 31 and a bottom end 32. The vertical segment 30 has a square cross-section and four external surface sides 33. One vertical segment side **33*c* has a plurality of apertures 34 formed therein in a row along the side's longitudinal axis which is defined as the axis extending from the vertical segment top end 31 to the vertical segment bottom end 32. The vertical segment top end 31 is attached to the horizontal segment distal end 23 by means of two flat, elongated iron pieces 35, one interconnecting the horizontal segment side 24c with the vertical segment side 33*c* and the other piece interconnecting the horizontal segment side 24*a* with the vertical segment side 33*a***.

The pulley-controlled variable weight structure 40 is comprised of three 4½ pulleys 41, a variable weight holder 50 and an interconnecting cable 56. One pulley **41*a* is fixedly attached to the underside 24***b* of the horizontal segment 21. A second pulley 41*b* is fixedly attached between the two iron pieces 35 and also between the horizontal segment distal end 23 and the vertical segment top end 31. A third pulley 41*c* is adjustable attached to a U-shaped holding bracket 44 whose middle segment 45 is positioned against the vertical segment outer side 33*d*. The two U-shaped holding bracket lateral sides 46 extend from the middle segment 45 along the vertical segment sides 33*a* and 33*c*, respectively. One lateral side 46 has an aperture 48 formed therein. A spring-loaded bolt 6 is inserted into the lateral side aperture 48 and into a selected vertical segment aperture 34 along the vertical segment side 33*c*, thereby locking the third pulley 41*c* into place. The vertical height of the third pulley 41*c* may thereby be adjusted upwardly or downwardly, depending upon the vertical segment aperture 34 chosen. The radial planes of the pulleys 41 are coincident with the plane formed by the joined horizontal and vertical segments 21, 30.

The weight holder 50 is comprised of a flat, plate-like element 51 with one end 54 of an upwardly protruding rod 52 centrally attached to the element 51. The unattached rod end 53 has a ring 55 attached thereto. The cable 56 has ring engagement hooks 57 at both ends 58, 59. One cable end 58 hook 57 is attached to the weight holder ring 55. The other cable end 59 is passed over the first pulley 41*a* from the horizontal segment proximal end 22 side to the horizontal segment distal end 23 side. The cable end 59 is then passed over the second pulley 41*b* from the horizontal segment side to the vertical segment outer side 33*d*. The cable end 59 is then passed under the third pulley 41*c* between the pulley 41*c* and the holding bracket middle segment 45 and then outwardly to the yoke assembly 60. Desired weight plates 8 are then added to the weight holder 50 to established a desired exercise resistance.

The yoke assembly 60 has a generally half cylinder shape with radial axes in horizontal planes. The yoke assembly 60 is held by an exerciser 5 at approximately the height of the exerciser's solar plexus 7. The yoke assembly 60 is hollow, and has a horizontally curved vertical front 61, an open rear 62, a vertical side defined as the leading edge 63, a vertical side defined as the lagging edge 64, a horizontal top 65 and a horizontal bottom 66. The curved front 61 has a top rim 74 joining the top 65 with the front 61, and a bottom rim 75 joining the bottom 66 with the front 61. The leading edge side 63 has an eye bolt 67 fixedly attached at the vertical midpoint 68 of the edge side 63. The cable end 59 is attached to the eye bolt 67. The cable 56 is then positioned about the yoke front 61, past the lagging edge 64 and to the adjustable pulley 41*c*.

The yoke top 65 and bottom 66 are solid and have circle segment shapes, i.e., generally less than a half-circle. The straight edges 70, 71 of the top 65 and bottom 66 begin at the junctions 72, 73 of the leading edge side 63 and the top and bottom rims 74, 75, respectively, and extend along chord lines subtending said rims 74, 75 to top rim and bottom rim points 76, 77 a measured circumferential distance from the lagging edge side 63. A flat, generally rectangular vertical element 80 centrally interconnects the top straight edge 70 and the bottom straight edge 71. The element 80 has a front surface 81 facing the interior of the 78 of the yoke assembly and an opposite rear surface 82 with a rectangular pad 83 attached thereto. Two cylindrical hand grips 84 are positioned side-by-side within the yoke interior 78 approximately midway between the element front surface 81 and the curved front 61. The grips 84 extend from yoke bottom 66 to yoke top 65 and are fixedly attached thereto.

In operation, the exerciser 5 grips the hand grips 84 and brings the yoke up to his body so that the pad 83 rests against his solar plexus 7. The exerciser 5 positions himself and the yoke assembly 60 so that the leading edge side 63 is farthest from the adjustable pulley 41*c*. The exerciser 5 then turns the yoke 60 horizontally away from the support section vertical segment 30. This results in the cable 56 coming under tension from the weights 8 on the weight holder 50 via the pulleys 41. The cable 56 is extended across the yoke front 61 thereby imparting a smooth resistance to the exerciser 5 and avoiding discomfort from direct contact with the cable 56. The lagging edge side 64 extends radially further around the exerciser 5 thereby protecting the exerciser from the cable 56 and also increasing the amount of turn available to the exerciser 5. The exerciser 5 may vary the angle of yoke turn as desired. The height of the cable 56 and yoke assembly 60 combination is easily adjusted by vertical adjustment of the third pulley 41*c*. The exerciser 5 may easily change the direction of exercise from the exerciser's left-to-right as shown in the Figures to a right-to-left motion by turning the yoke upside down.

It is understood that the above-described embodiment is merely illustrative of the application. Other embodiments may be readily devised by those skilled in the art which will embody the principles of the invention and fall within the spirit and scope thereof.

I claim:

1. An improved hip strengthening exercise apparatus, comprising:

a frame assembly adapted for attachment to a vertical structure;

a pulley-controlled variable weight structure including a cable attached to said frame assembly; and hand-held, hollow yoke assembly engaging said weight structure wherein said yoke assembly has an interior, a horizontally curved vertical front, an open rear, a vertical side defined as the leading edge, a vertical side defined as the lagging edge, a horizontal top and a horizontal bottom, said curved front having a top rim joining the top with the front, and a bottom rim joining the bottom with the front, said top and bottom being solid and having circle segment shapes with each having a straight edge, said top and bottom straight edges beginning at junctions formed by the leading edge side and the top and bottom rims, and extending along a chord line to top rim and bottom rim points a measured circumferential distance from the lagging edge side, said leading edge side having an eye bolt fixedly attached at a vertical midpoint of the edge side; wherein a cable ring engagement hook is attached to said eye bolt and said cable is positioned about the yoke front, past the lagging edge and to said pulley controlled variable weight structure.

2. An apparatus as recited in claim 1, wherein said frame assembly is comprised of:

a holding section, said holding section being comprised of a generally flat, plate-like portion with a plurality of holes formed therein, said plate lying in a vertical plane parallel to a plane of the vertical structure, said plate having an under surface and an outer surface, said under surface being positioned against the vertical structure and attached thereto by means of fasteners inserted through the plate holes into the vertical structure, said outer surface facing away from the vertical structure and having an open piece of hollow tubing centrally, perpendicularly and fixedly attached thereto; and an L-shaped support section comprised of:

a horizontal segment having a proximal end, a distal end, an underside and a cross-section less than the cross-section of the tubing piece, said proximal end being inserted into the plate tubing piece; and a vertical segment with a top end, a bottom end, and an outer side, said top end being attached to the horizontal segment distal end by means of two flat, elongated pieces.

3. An apparatus as recited in claim 2, wherein said pulley-controlled variable weight structure is comprised of:

three pulleys, the first of which is fixedly attached to the underside of the horizontal segment, the second of which is fixedly attached between two iron pieces and also between the horizontal segment distal end and the vertical segment top end, the third of which is attached to the vertical segment outer side;

a variable weight holder comprised of a flat, plate-like element with one end of an upwardly protruding rod centrally attached thereto, said unattached rod end having a ring attached thereto, said holder adapted to receive weight plates to establish a desired exercise resistance; and an interconnecting cable with two ends, each said end having a ring engagement hooks attached thereto, one said cable end hook being attached to the weight holder ring and the other said cable end is passed over the first pulley from the horizontal segment proximal end side to the horizontal segment distal end side, over the second pulley from the horizontal segment side to the vertical segment outer side, under the third pulley between the pulley and the vertical segment outer side, to the yoke assembly for engagement.

4. An apparatus as recited in claim 3, wherein:

said yoke assembly has a half cylinder shape with radial axes in horizontal planes.

5. An apparatus as recited in claim 1, wherein said yoke assembly is further comprised of:

a flat, generally rectangular vertical element centrally interconnecting the top straight edge and the bottom straight edge, said element having a front surface facing the interior of the yoke assembly and an opposite rear surface with a rectangular pad attached thereto; and two cylindrical hand grips are positioned side-by-side within the yoke interior midway between the element front surface and the curved front, said grips extending from yoke bottom to yoke top and being fixedly attached thereto.

6. An apparatus as recited in claim 5, further comprising:

said tubing piece having an aperture formed therein;

said horizontal segment has an aperture formed therein near to the horizontal segment proximal end; and a plate tubing spring bolt inserted through the tubing piece aperture and adapted to engage the horizontal segment aperture, thereby locking the horizontal segment in place.

7. An apparatus as recited in claim 6, further comprising:

said vertical segment having a plurality of apertures formed therein in a vertical row; and said third pulley being adjustable attached to a U-shaped holding bracket with a middle segment and two lateral sides, said middle segment being positioned against the vertical segment outer side, said lateral sides extending from the middle segment about the vertical segment side, one lateral side having an aperture formed therein; and a spring-loaded bolt inserted into the lateral side aperture and into a selected vertical segment aperture along the vertical segment side thereby locking the third pulley into place.

8. An apparatus as recited in claim 7, further comprising:

said tubing piece having a square cross-section and four external surface sides;

a horizontal segment having a square cross-section and four external surface sides;

a vertical segment having a square cross-section and four external surface sides, one said vertical segment side having a plurality of apertures formed therein in a row along the side's longitudinal axis defined as the axis extending from the vertical segment top end to the vertical segment bottom end; and said third pulley adjustably attached to said U-shaped holding bracket whose middle segment is positioned against the vertical segment outer side and whose lateral sides extend from the middle segment along adjacent vertical segment sides.

* * * * *